United States Patent [19]

Zochert et al.

[11] 4,155,279

[45] May 22, 1979

[54] HYDRAULICALLY OPERATED VALVE WRENCH

[75] Inventors: Marvin L. Zochert, Pineville; John R. DeCuir, Marksville, both of La.

[73] Assignee: Dresser Industries, Inc., Dallas, Tex.

[21] Appl. No.: 849,291

[22] Filed: Nov. 7, 1977

[51] Int. Cl.[2] ..... B25B 13/46

[52] U.S. Cl. ..... 81/57.39

[58] Field of Search ..... 81/57.39, 57.33, 57.34, 81/57.35; 294/102 A; 279/56, 57

[56] References Cited

U.S. PATENT DOCUMENTS

| | | | |
|---|---|---|---|
| 2,699,589 | 1/1955 | Redell | 294/102 A |
| 2,700,201 | 1/1955 | Bannister | 294/102 A |
| 2,823,450 | 2/1958 | Thomas | 81/57.35 |
| 4,031,784 | 6/1977 | Cobbe | 81/57.39 |

*Primary Examiner*—James L. Jones, Jr.
*Attorney, Agent, or Firm*—Daniel Rubin

[57] ABSTRACT

A hydraulically operated wrench comprised of a body saddle, bonnet clamp and hydraulic system providing controlled high torque turning force for in-line assembly and disassembly of threadedly connected valve housing components such as the body and bonnet. With the saddle and clamp separately secured to the valve body and bonnet, respectively, a pump actuated piston/cylinder is mounted on the saddle with its piston end secured to the clamp. The axis of the piston/cylinder is aligned with a force vector normal to the bonnet radius such that when the piston is extended outward by operation of a jack pump in response to hydraulic pressures imposed against the piston/cylinder it imposes a high force turning moment against the bonnet relative to the body.

3 Claims, 6 Drawing Figures

FIG. 3
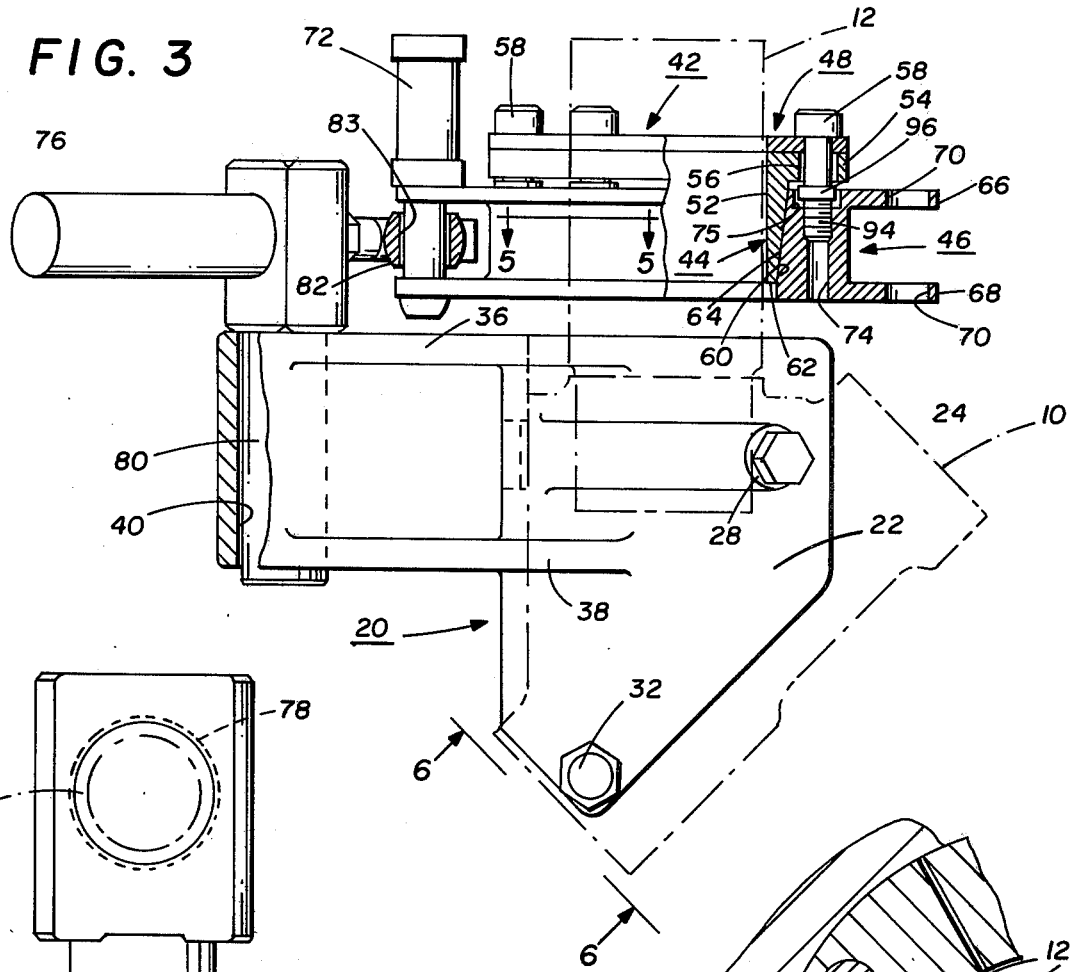
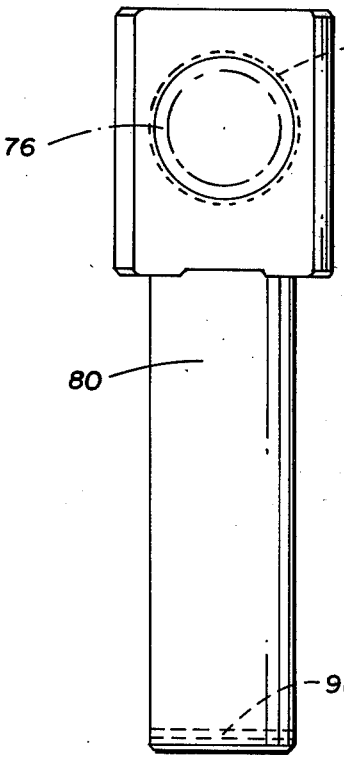
FIG. 4
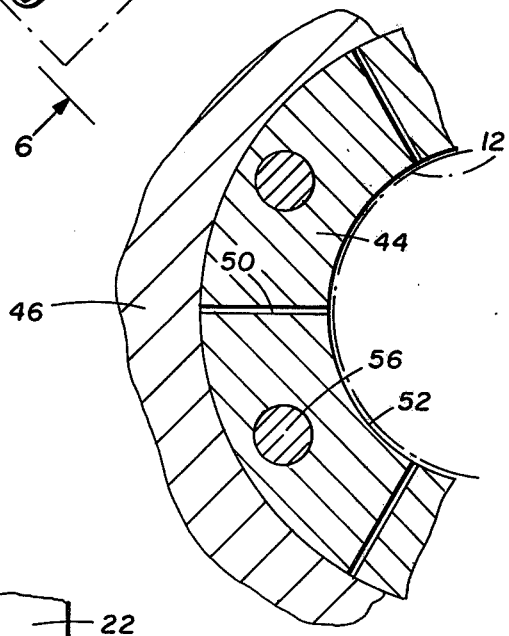
FIG. 5
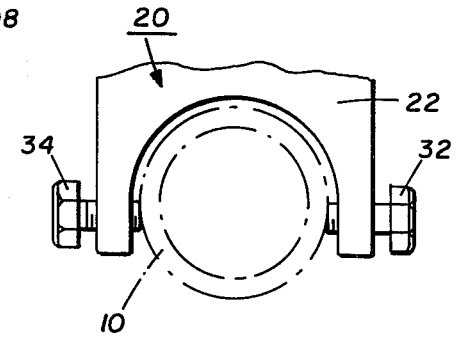
FIG. 6

HYDRAULICALLY OPERATED VALVE WRENCH

BACKGROUND OF THE INVENTION

1. The field of art to which the invention pertains includes the art of tools and more specifically step-by-step operable machine wrenches.

2. Line valves having a threadedly connected bonnet and body construction are commonly utilized for high pressure, high temperature applications requiring extreme assembled tightness. Such tightness, which may for example require turning torques on the order of 3000 ft/lbs. to achieve, are readily attained during factory assembly but can represent a significant obstacle where in-line maintenance of the valve is to be subsequently conducted. Not only is the ability to disassemble and reassemble valves of this type without removing it from the line of paramount importance to the user, but because of the magnitude of torque indicated the use of large wrenches, impact wrenches, cheater bars or the like is generally precluded. Moreover, when such valves are used, for example, in the primary containment area of a nuclear power plant, the presence of borated water crystals restricts the use of pneumatic power devices or the like while the use of adjacent piping to provide reaction torque is frequently prohibited by governmental code. At the same time, such valves are usually manufactured without any provision for a wrench attachment while the machining of keyways, slots, flats or spanner holes in the valve bonnet is not permitted on site. Consequently, there has been a long-felt need for wrench apparatus capable of functioning for these purposes. Despite recognition of the problem and with knowledge of power wrenches such as disclosed, for example, in U.S. Pat. Nos. 4,027,560 and 4,027,561, a ready solution for this specific requirement has not heretofore been known.

SUMMARY OF THE INVENTION

This invention relates to power wrenches and more specifically to a hydraulic operated wrench adapted for in-line disassembly and reassembly of a threadedly connected valve housing as may exist between the bonnet and body of a line service valve. By means of the power wrench hereof, it is readily possible to impose the magnitude of turning torque necessary to disassemble the valve for maintenance purposes without removing the body from the pipe line being served thereby. At the same time, the wrench hereof with a relatively simple construction and with a minimum expenditure of effort enables an accurate control of tightening torque to ensure meeting the manufacturer's torquing specification prescribed for the particular valve.

The foregoing is achieved by means of the power wrench of the invention comprised of a body saddle adapted for secured reaction mounting on the valve body; a bonnet clamp adapted for secured wedge-gripped mounting onto the valve bonnet and a jack pump operable piston/cylinder adapted for mounting on the body saddle. The piston end of the piston/cylinder is connected to the bonnet clamp in an orientation imposing a turning moment against the bonnet when the piston end is extended outward from its cylinder. On each occasion that the piston is displaced outward, its end provides a less than full turn arc of rotation to the bonnet in the intended direction. Following full expansion of the piston, its extended end is disconnected from the bonnet clamp assembly to be withdrawn within the cylinder. The end is then reconnected to the bonnet clamp assembly at the next closer location for repeating the cycle until disassembly or reassembly of the valve housing is completed. By employing a pump of predetermined piston area as, for example, one square inch, the applied force is readily determinable from a pressure gauge reading. With a known moment arm, a known turning torque can be controllably applied to the bonnet as required and the pressure gauge can readily be calibrated to indicate values of torque. While relatively simple to fabricate as well as to operate, the construction hereof is thereby able to fulfill a long-felt need in a highly economical and efficient manner.

It is therefore an object of the invention to provide a novel power wrench for the disassembly and reassembly of threadedly joined valve housing components.

It is a further object of the invention to provide a novel power wrench as in the previous object capable of smoothly applying without impact extremely high magnitudes of turning torque at controlled levels for effecting disassembly and reassembly of a valve bonnet from its associated body without removing the body from its pipe line service connection.

It is a still further object of the invention to effect the foregoing objects with a power wrench of relatively simple and economical construction as to make it readily suitable for such uses as compared to known servicing techniques of the prior art.

BRIEF DESCRIPTION OF THE DRAWINGS

FIG. 3 is an elevation view partially broken away in section of the power wrench hereof;

FIG. 4 is an elevation view of the piston support post; and

FIGS. 5 and 6 are sectional views taken substantially along the lines 5—5 and 6—6, respectively, of the previous figures.

Referring now to FIG. 1, the valve illustrated comprises a line valve of a type commercially available, as for example a HANCOCK (trademark) 3050W Y-pattern diaphragm valve that includes a body 10 to which a bonnet 12 is threadedly connected. A handle 14 on a central stem 16 extending through bonnet bushing 18 serves to operate the valve in a well known manner. For the purpose of internal maintenance, it is usually required that bonnet 12 be threaded outwardly from the body in order to gain access to the internal operating components.

Figure 1:
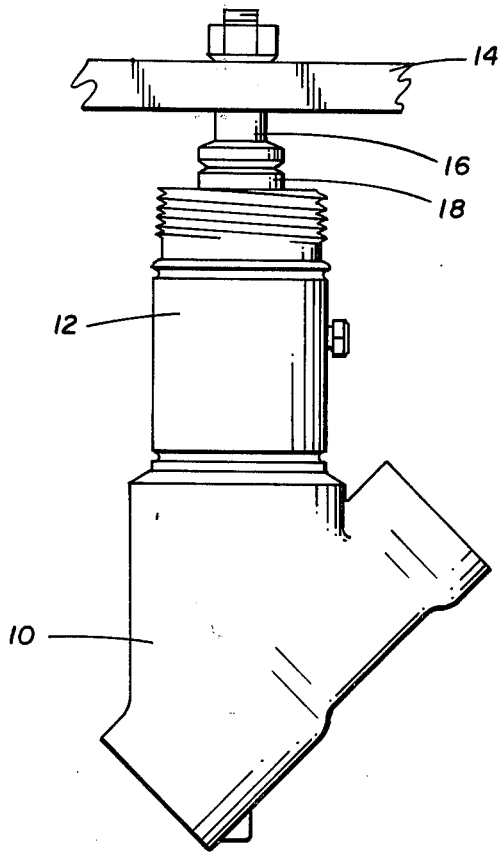
FIG. 1 is an exterior view of a valve on which use of the power wrench hereof is exemplified.

Referring now to the remaining figures, the power wrench in accordance herewith includes a body saddle 20 comprised of a more or less open ended yoke type body clamp 22 adapted for a slip-on embrace of valve body 10. Opposite clamping bolts 24 and 26 extending through bosses 28 and 30, respectively, secure the saddle in place while displaced reaction pads 32 and 34 are adjustable to withstand the imposed turning moment as will be understood. Cast integral with and extending laterally outward from clamp 22 are a pair of parallel arms 36 and 38 which at their distal ends are joined to define a vertical bore 40.

For separate mounting on bonnet 12 there is provided a bonnet clamp assembly 42 comprised of a plurality of loosely constrained segments 44 forming a collet jaw. The jaw has an inside diameter 52 sized to generally accommodate the outside diameter of bonnet 12 and is adapted for a wedged interfit with an underlying collet ring 46. A superposed equalizing ring 48 when assembled to the segments via jamming screws 58 maintains the segments in their placement position. Each of the jaw segments 44 has an arcuate extent on the order of about 60° and adjacent jaws are separated from each other by a saw cut 50 on the order of about 3/32nds inches in width. Integrally located at the peripheral top side of each segment is an arcuately coterminous horizontal flange 54 containing a plurality of spaced apertures 56 through which to receive the jamming screw 58. From the underside of flange 54 the segments are peripherally tapered frusto-conically inward along the surface 60 toward their distal ends 62.

Collet ring 46 includes an annular internal taper 64 complementing the taper 62 of segments 44 and peripherally is integrally formed with a pair of axially spaced annular flanges 66 and 68. The flanges are coaxially apertured at 70 about their circumference for receiving a driving pin 72, as will be explained. Radially inward bores 74 located angularly coincident with segment apertures 56 in the collet jaw together receive jamming screw 58 and terminate at their upper end in a counterbore 75.

For this purpose screws 58 are threaded at their lower end 94 and support a collar 96 thread mounted thereon after initial placement through the provided apertures of rings 44 and 48. Collet ring 46 is then loosely mounted to the underside thereof via a loose threading of screws 58 in the upper threaded end of bores 74 and receiving collar 96 in counterbore 75. With collet ring 46 in place the assembly of clamp 42 is completed in preparation for mounting about bonnet 12.

Figure 2:
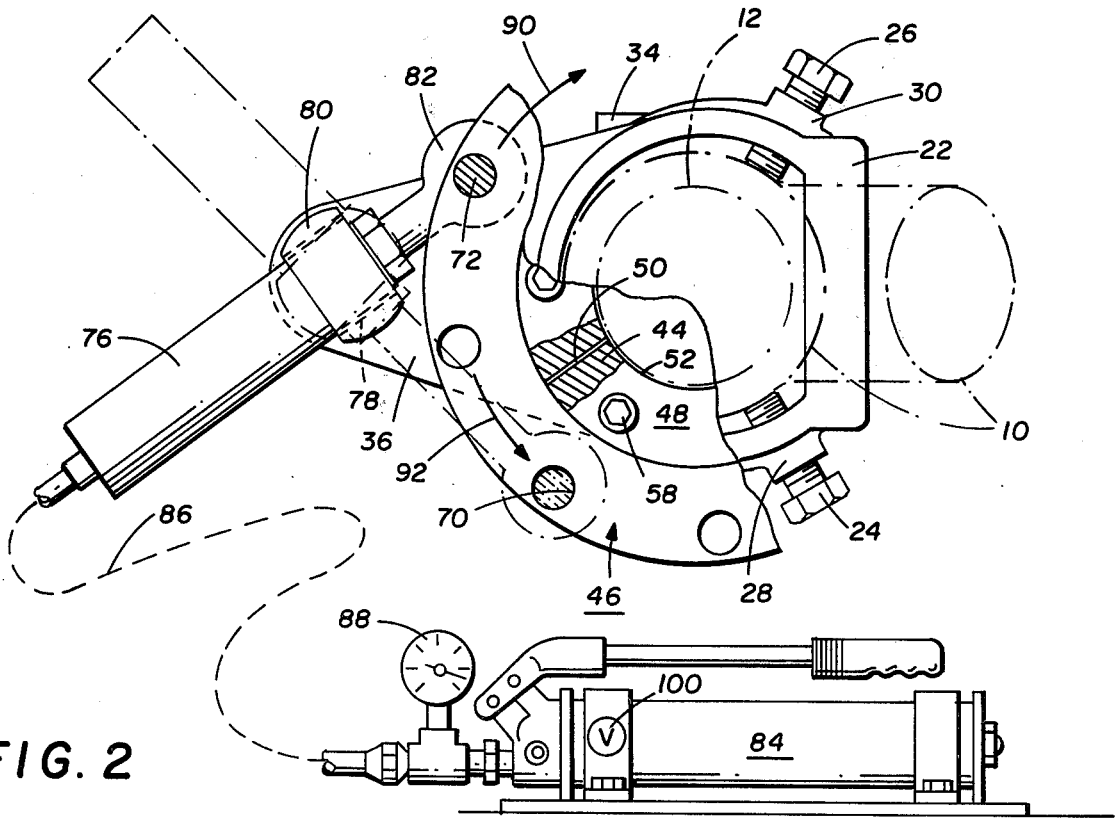
FIG. 2 is a plan view partially broken away illustrating the power wrench hereof.

The hydraulic system for operating the power wrench is comprised of a hydraulic piston/cylinder 76 supported screw threaded at 78 through the head of a T-shaped swivel post 80 in turn vertically supported loosely rotatable in saddle bore 40. A looped rod end 82 connected to the piston of unit 76 is centrally bored at 83 such that when aligned intervening between spaced ring apertures 70 can be secured to collet ring 46 by means of a pin 72 inserted therethrough. Being relatively positioned in the manner shown solid in FIG. 2, it can be seen that forcing rod 82 to extend ouward will cause a clockwise rotation of clamp 42 and bonnet 12 in the direction of arrow 90. Conversely, when reoriented ninety degrees displaced in the manner shown dashed it will cause a counterclockwise rotation in the direction of arrow 92. For actuating piston/cylinder 76 in order to extend end 82 there is provided a conventional hydraulic jack pump 84 of a type commercially available capable of generating pressure sufficient to supply the required torque and including a valve 100 in its side for relieving piston pressure when required. The generated pressure is then transmitted through hose 86 and will be of magnitude indicated by gauge 88. The graduations of gauge 88 can also provide direct indications of torque. A transverse small diameter bore 98 is provided through the lower end of post 88 to receive a cross pin (not shown) where required to retain the post in an inverted placement.

In operation, a body saddle 20 generally presized to conform with the width dimension of valve body 10 is longitudinally placed thereon before being securely clamped via opposite bolts 24 and 26. Opposite reaction pads 32 and 34 are then adjusted to fit against the body for withstanding the anticipated reaction forces that will be imposed from the turning moment to be applied. With clamp 42 in place loosely surrounding bonnet 12, bolts 58 are tightened causing a wedging action to occur between the contiguous tapered surfaces 60 and 64. This, in turn, closes the collet jaws 44 in a chucking action about bonnet 12 until a tight secure grip is obtained therebetween ultimately causing upward movement of ring 46.

With piston/cylinder 76 secured extending through swivel post 80, the post is placed in saddle bore 40 and oriented in either the position shown solid for rotating the bonnet clockwise in the direction of arrow 90 or in the position shown dashed for rotating the bonnet counterclockwise in the direction of arrow 92. Inserting pin 72 through the appropriate nearest aperture 70 connects the rod end 82 to ring 46. With valve 100 closed, jack pump 84 is manually operated until sufficient pressure is developed for expanding the piston to forcibly extend end 82 outward. Extending the rod end effects rotative motion to the bonnet in incremental amounts correlated to the linear stroke capability of the piston/cylinder 76. After each extended stroke of the piston, pressure from the piston/cylinder is removed by opening valve 100 permitting pin 72 to be removed. An internal spring (not shown) then functions to retract end 82 to its inward position. After reconnecting end 82 to the next closest bonnet aperture 70, the cycle is repeated and continues repetitively until complete step-by-step disassembly or reassembly is attained.

By the above description there is disclosed a novel power wrench for use on threadedly assembled line valves to achieve high levels of turning torque in place without the necessity of removing the valve body from the line. The wrench is of a relatively simple construction and easy to operate making it a highly desirable product to have available at an installation requiring such on-site servicing of the valves as to solve a long standing need therefor. Whereas a diaphragm valve has been disclosed for purposes of illustration, it is apparent that any type valve or valve size can be similarly accommodated by the wrench hereof by ensuring only that the saddle and clamp are appropriately sized to accommodate the valves on which they are to be employed.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. A power operated valve wrench for assembly or disassembly of threadedly connected valve housing components, comprising in combination:

(a) saddle means comprising a body saddle for secured mounting on the body component of the connected valve housing components:

(b) clamp means for secured mounting on the bonnet component of the connected valve housing components and comprising a clamp having a collet jaw adapted for loose mounting on the valve bonnet and chucking means operable to close said collet jaw into a gripping relation with the valve bonnet;

(c) said chucking means comprising a collet ring surrounding said collet jaw in a wedged interfit therewith and including an annular flange about the collet ring periphery and a plurality of uniformly spaced apertures extending through a radial face of said flange and bolt means operable to axially displace said collet ring relative to said jaw for effecting said gripping relation;

(d) a power actuated piston/cylinder having an inlet adapted for receipt of a fluid pressure supply for operating the piston/cylinder between a retracted and extended position;

(e) connection means adapted to connect the piston end of said piston/cylinder to said clamp means and comprising a pin removably placeable in an aperture of said flange for connecting said piston end thereto; and (f) support means for supporting said piston/cylinder secured on said saddle means in an orientation providing a turning moment against said clamp means when the piston of said piston/cylinder is gradually extended in response to fluid pressure received at its inlet, said support means being reversible between a first orientation for assembling a valve and a second orientation for disassembling a valve.

2. A power operated wrench according to claim 1 in which said support means comprises a swivel post.

3. A power operated wrench according to claim 1 in which said bolt means comprises a plurality of bolts extending inward of said collet jaw circumferentially displaced about a radial face thereof for attaching said collet ring.

* * * * *